United States Patent [19]

Moore

[11] Patent Number: 4,821,462

[45] Date of Patent: Apr. 18, 1989

[54] DENTAL INSTRUMENT SHARPENING HONE

[76] Inventor: Steven B. Moore, 7846 S. Logan St., Littleton, Colo. 80122

[21] Appl. No.: 91,415

[22] Filed: Aug. 31, 1987

[51] Int. Cl.[4] ..... B24D 15/06

[52] U.S. Cl. ..... 51/214; 51/221 BS; 33/201; 76/82; 76/88

[58] Field of Search ..... 51/214, 211, 212, 221 BS, 51/21 R, 220, 156, 157, 159, 239, 238 T, 59 R; 76/82, 88; 33/201

[56] References Cited

U.S. PATENT DOCUMENTS

| | | | |
|---|---|---|---|
| 1,357,753 | 11/1920 | Webster | 33/201 |
| 1,411,713 | 4/1922 | Downing | 51/221 R |
| 1,605,784 | 11/1926 | Schmitt | 51/221 R |
| 2,287,910 | 6/1942 | Slack | 51/59 R |
| 2,578,081 | 12/1951 | Miller et al. | 51/59 R |
| 3,436,872 | 4/1969 | Warren | 51/218 R |

FOREIGN PATENT DOCUMENTS

| | | | |
|---|---|---|---|
| 0376051 | 4/1922 | Fed. Rep. of Germany | 33/201 |
| 0908572 | 10/1945 | France | 33/201 |
| 0250148 | 4/1926 | United Kingdom | 33/201 |

*Primary Examiner*—Frederick R. Schmidt
*Assistant Examiner*—Robert A. Rose
*Attorney, Agent, or Firm*—Edwin L. Spangler, Jr

[57] ABSTRACT

A hone for reconditioning dental instruments of the type having a handle terminating in a blade including a planar portion bordered by a sharp edge is disclosed that is characterized by a planar abrasive surface supported upon a base alongside of which a protractor-like element is mounted for rotation. The protractor-like element displays at least one straight line whose angular relation to the abrasive surface changes as the element rotates along with a plurality of other indicia by means of which the straight line can be set at a particular angle with respect to the abrasive surface that is the same angle that the handle of the instrument to be reconditioned must bear to the latter in order for the planar and sharp edges of its blade to be properly restored as they are moved to and fro across the abrasive surface.

10 Claims, 2 Drawing Sheets

DENTAL INSTRUMENT SHARPENING HONE

BACKGROUND OF THE INVENTION

Dentists and their hygienists are faced with an ongoing problem of keeping the instruments sharp and properly surfaced with which they clean their patients' teeth. Of course, the primary concern is the comfort and satisfaction of the patient which, obviously, suffers a great deal if the instruments being used are dull and misshapen. In addition, however, the use of dull instruments require more of the operator's time to do a proper job if, in fact, it is even possible to accomplish a satisfactory cleaning with improperly conditioned equipment. Last, but by no means least, is the fact that poorly sharpened and maintained dental instruments become useless more quickly and must be replaced at considerable, but avoidable, expense.

There are basically two techniques used in the sharpening of dental instruments, one a manual method employing a hand-held hone and the other using a mechanical grinder of some sort. Powered grinding wheels have serious limitations which make them highly objectionable to a conscientious technician. To begin with, they remove too much metal and thus contribute to the premature need to dispose of the instrument and buy another. Secondly, the heat developed destroys the temper in the working tip of the instrument. All in all, it is virtually impossible to produce the desired flat even surfaces and sharp edges required in such a instrument using a high speed motor-driven grinding wheel.

Hand-sharpening, too, has its drawbacks. It is slow, tiring and very exacting. The main problem shared by both the manual and motorized techniques is, however, the considerable amount of skill and training required of the operator in order to properly sharpen the wide variety of instrument configurations he or she is called upon to work with.

When the instrument comes from the factory it, obviously, is sharp and properly configured to do the job for which it is intended. Included in addition to the sharp edges are surfaces and surface angles that are very important to the proper functioning of the instrument; however, these surfaces can be obliterated and their reference value lost through just one or two attempts at sharpening the instrument by an unskilled person. For instance, it is quite common to find such instruments with the original planar surfaces rounded to a point where they become all but impossible to reconstruct. Microscopic examination will reveal certain areas to be sharper than others, misshapen contours and excessive metal loss, all of which contribute to the discomfort of the patient, an overly long session in the chair and in all probability a poor cleaning job.

FIELD OF THE INVENTION

The invention forming the subject matter hereof relates to a novel, preferably hand-held, sharpening hone that includes a transparent protractor-like element imprinted with instrument-handle alignment indicia rotatable relative to the plane of the sharpening stone which the user can preset at different angles corresponding to the face angle of a particular instrument defined by the axis of its handle and the planar surface of its blade thereby facilitating the sharpening process while, at the same time, considerably reducing the degree of skill and training required to do a proper sharpening job quickly and easily.

DESCRIPTION OF THE RELATED ART

At the present time, applicant is unaware of any hand-held dental instrument hone having an adjustable guide associated with the stone for use in aligning the blade so as to reproduce and maintain the precise angular relationship between its planar surface and handle while the edge is being restored that existed originally when the instrument was first made.

Applicant is, however, aware of various sharpening hones for knives, scissors and the like that employ some sort of fixed guide that assists the user in maintaining the proper blade angle with respect to the stone. Such hones, however, are of no particular value in sharpening a dental instrument due to the often complex curvature of the blades, the relationship of the flat surfaces to the edges alongside thereof and other unsymmetrical features.

SUMMARY OF THE INVENTION

It has now been found in accordance with the teaching of the instant invention that the disadvantages inherent in trying to teach even a skilled dentist, dental technician or hygienist how to sharpen and otherwise condition their dental instruments can, in large measure, be solved by the simple, yet unobvious, expedient of mounting a transparent protractor-like element for rotational movement alongside one or in between a pair of the sharpening stones and providing the protractor-like element with indicia movable therewith by means of which the user can visually align the handle of the instrument to be sharpened at the precise angle the planar surface of the blade made with the handle when it came from the manufacturer. By so doing, and while maintaining this same preset angle by watching the attitude of the instrument handle with respect to this indicia through the transparent protracter as it is being manipulated to restore its sharp edge and adjacent flat, the instrument can be brought back to substantially its original condition quickly and easily by even relatively unskilled persons. The proper angle that is to be maintained for each different type of dental instrument can be keyed to indicia along the edge of the protractor-like element and then indexed in any of several different ways with reference to the plane defined by the sharpening stone or stones even though the axis of rotation may be offset from the latter. Even a badly abused instrument can thus be restored to prime condition despite the fact that the instrument itself has none of its original reference planes or angles left. The instrument is a teaching aid that functions while being used to reveal to the user the inadequacies, if any, in his or her sharpening technique.

Accordingly, it is the principal object of the present invention to provide a new and useful sharpening hone for dental instruments.

A second objective is the provision of a device of the class described which greatly facilitates the process of learning how to properly recondition dental instruments that have become dull.

Another objective of the within-described invention is that of providing an alignable hone whereby with but one simple adjustment a user can potentially duplicate the surfaces present in the original instrument.

Still another object is to provide a specialized, preferably hand-held and manually-operated honing device that substantially completely eliminates the problems associated with the sharpening of bladed dental picks and the like using powered grinding wheels.

Further objects are to provide a precision sharpening hone of the class described which is easy to use, versatile, relatively inexpensive, efficient, lightweight yet rugged, compact and even decorative.

Other objects will be in part apparent and in part pointed out specifically hereinafter in connection with the description of the drawings that follows.

DESCRIPTION OF THE PREFERRED EMBODIMENTS

Figure 1:
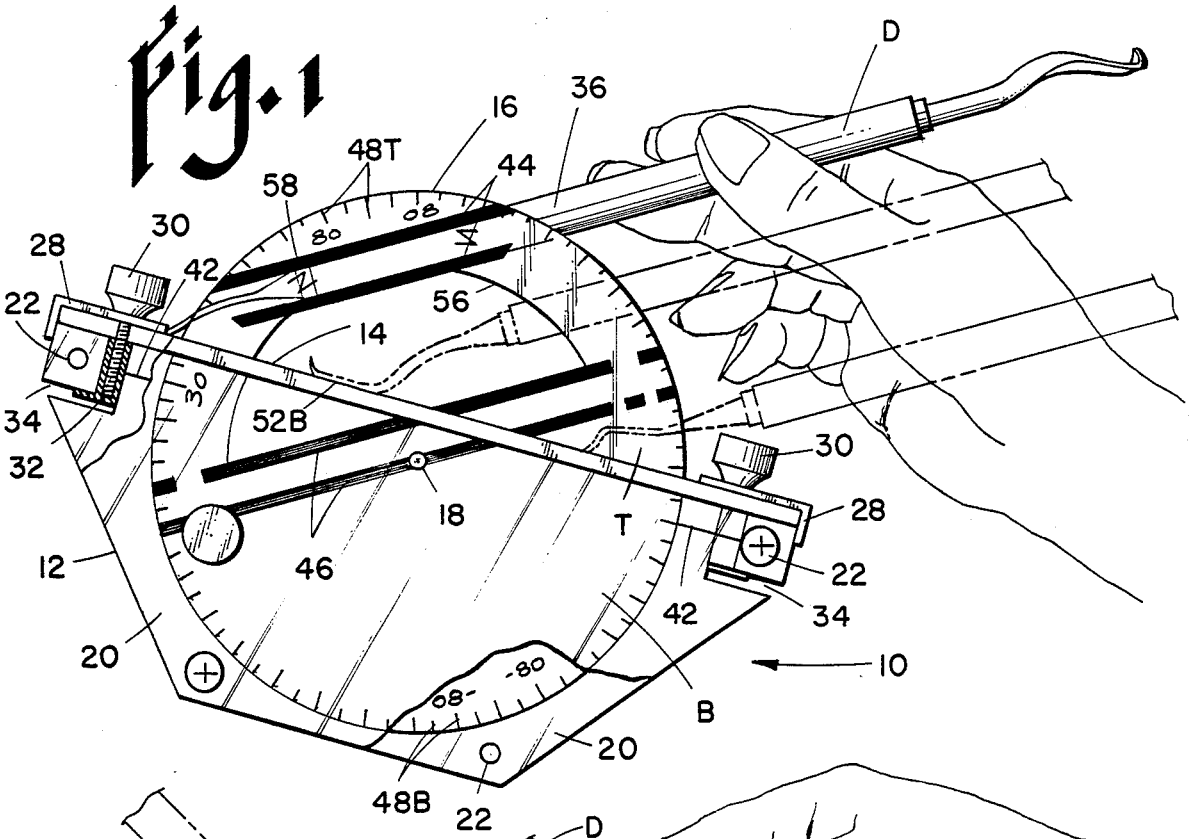
FIG. 1 is a front elevational view showing the hone in use with the instrument handle aligned with the alignment indicia displayed upon the upper portion of the transparent protractor-like element throughout the sharpening stroke, portions of which have been broken away to better reveal the interior construction.
Figure 2:
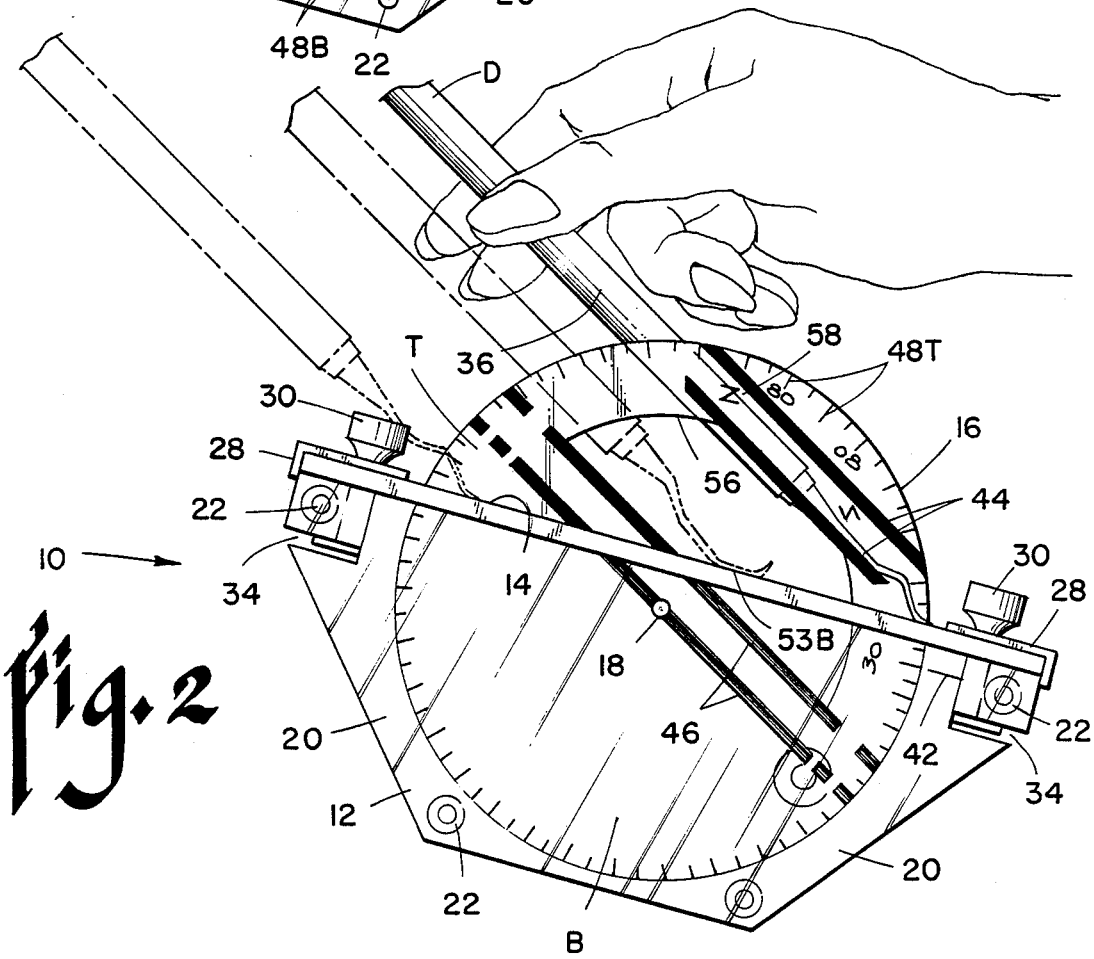
FIG. 2 is a front elevational view similar to FIG. 1 but of the other side of the hone showing how the abrasive surface on the near side of FIG. 1, protractor-like element and indicia thereon are used to reshape the mirror-image blade on the opposite end of the handle.

Referring next to the drawings for a detailed description of the present invention which has been broadly designated by reference numeral 10, numeral 12 has been chosen to similarly designate the base, numeral 14 the abrasive-surfaced planar elements used for the sharpening operation and numeral 16 the protractor-like element mounted on the base for rotational movement about axis 18 in substantially right angular relation to the aforementioned planar elements. In the particular form illustrated, the base 12 will be seen comprised of a pair of generally trapezoidal-shaped blocks 20 of a rigid transparent material like, for example, the plastic sold under the trademark "Lucite". Blocks 20 are shown fastened together by fasteners 22 at the corners thereof and held in fixed spaced relation to one another by spacers 24, one of which has been shown in FIG. 3. The slot 26 (FIGS. 3 and 4) between the base-forming blocks 20 houses the protractor-like element 16 for rotational movement about axis 18. Something less than about half of this element projects above the abrasive-surfaces 14 as seen in FIGS. 1 and 2.

Simple L-shaped clips 28 attached by thumbscrews 30 screwed onto the internally-threaded ends of broad-headed fasteners 32 housed in side-opening slots 34 of the base located at the upper outside corners thereof detachably mount the two abrasive-surfaced elements 14 in side-by-side relation alongside the slot 26. By loosening the thumbscrews 30, the elements 14 can be slid from underneath the horizontally-disposed legs of the L-shaped clips, turned around, upside down or replaced altogether if they become worn.

Abrasive-surfaced elements 14 can, of course, be fabricated from various materials such as ceramic, natural stone and even smooth-surfaced materials to which an abrasive coating has been applied. No novelty is predicated upon these abrasive-surfaced materials since they are commonplace in the art.

The protractor-like element 16 is the single most important and novel adjunct to the hone 10 and it can best be seen in FIGS. 1 and 2 to which specific reference will next be made. It is preferably transparent as is the base 12 so that the dental instrument D and particularly its handle 36 can be seen through it in the manner illustrated in both of the aforementioned figures. While, obviously, the portion T which upon rotation thereof lies exposed above the plane of the abrasive surfaces is always visible, the portion B lying between the leaves 20 of the base is hidden from view unless the base is transparent. As will be explained presently, in some positions of the instrument while being sharpened, its handle 36 lies above the base while in others it will lie below the latter.

Figure 3:
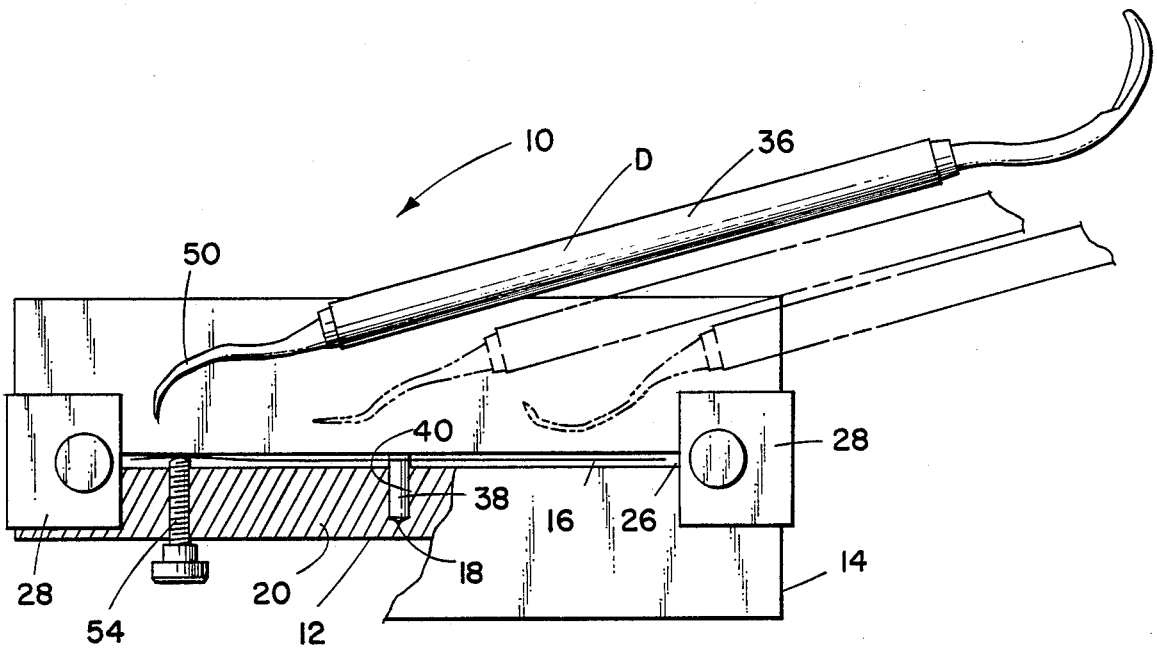
FIG. 3 is a fragmentary top plan view corresponding to FIG. 1 of the drawings, portions of one of the stones having been broken away and the base shown in section so as to reveal the mechanism by means of which the protractor-like element is set at a particular angular position; and, FIG. 4 is a fragmentary top plan view corresponding to FIG. 2, portions again having been broken away and shown in section to show the shaft upon which the protractor-like element turns and other features.
Figure 4:
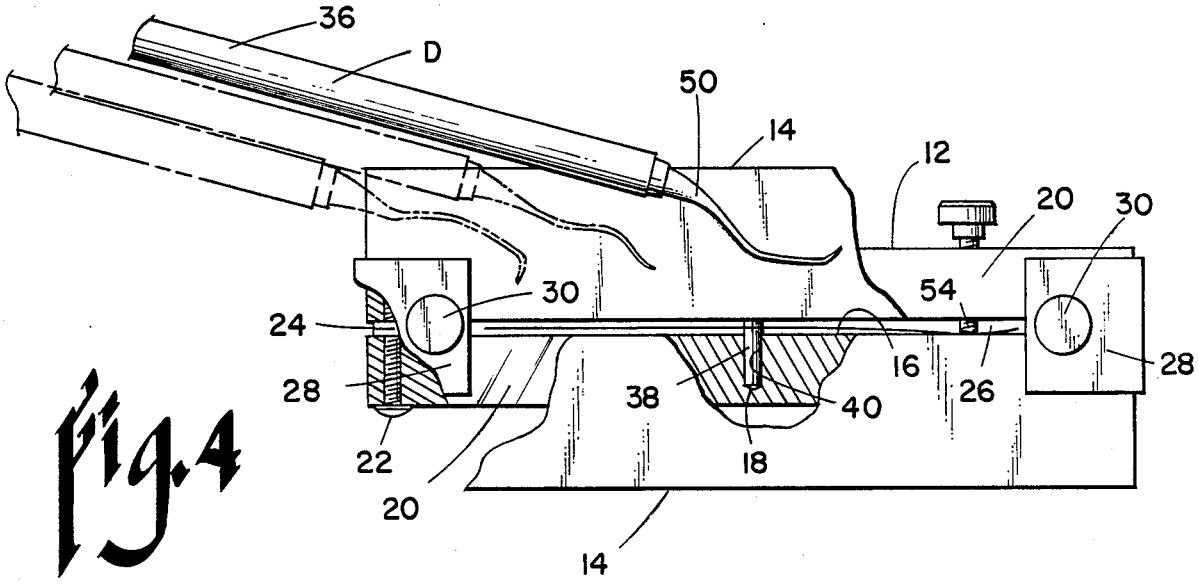

Axis of rotation 18 is defined by a stubshaft 38 journalled for rotation in a pair of transversely-aligned sockets 40 provided in the leaves 20 of the base 12 as seen in FIGS. 3 and 4. This axis 18 lies at right angles to the slot 26 and parallels the abrasive surfaces 14 thus placing the protractor-like element in perpendicular relation to the latter throughout its angular excursion. As shown, the socket is offset slightly below the plane of the abrasive surfaces so as to not interrupt the continuity of the latter. For this reason, one or more index marks 42 on the base offset the same distance beneath the top plane of the abrasive surfaces function as so-called "witness marks" by means of which the precise angular relation the handle-alignment indicia 44 and 46 carried by the protractor-like element make with these same abrasive surfaces can be accurately set when aligned with the angle-reading indicia 48 provided along the edge of the protractor-like element, all of which will be explained in greater detail presently.

Again with reference to FIGS. 1 and 2, it can be seen that in the particular form illustrated there are two sets, 44 and 46, of handle-orienting indicia on the face of the protractor-like element 16. The first of these, 44, comprises a pair of space parallel straight lines occupying a chordal relation to the circular wheel or disk constituting the protractor-like element. Both of the aforementioned lines lie in the portion T of the element 16 lying above the abrasive surfaces 14. The second set of handle-orienting indicia 46, on the other hand, have substantial portions thereof projecting below the plane of the abrasive surfaces regardless of the angular orientation of element 14. In other words, there is always some portion of the handle-orienting indicia 46 visible to the user on the covered portion B of the protractor-like element through the transparent leaves 20 of the base. As illustrated, indicia 46, like indicia 44, consists of a pair of parallel straight lines. In the case of the lines 46, one of the two is shown extending diametrically across the wheel and dividing same into two semicircular parts.

Starting with the upper set of handle-orienting indicia 44, their purpose as shown quite clearly in FIGS. 1 and 2 is to provide a means by which the handle 36 of the dental instrument D to be sharpened can be oriented in the proper angular relation to the honing surfaces 14. As shown, these parallel straight lines are spaced apart approximately the same distance as the thickness of the instrument handle 36 which varies very little from instrument to instrument or one manufacturer to another. It is important to realize that a single line, pair or series of dots, dashed or other visible indicia capable of defining at least one straight line is all that is necessary to align the instrument handle at the proper angle relative to the abrasive surfaces. On the other hand, a pair of rather wide, black straight lines spaced apart the approximate thickness of the instrument handle make the alignment job a whole lot easier.

Looking specifically at FIG. 1, the right hand of the person sharpening the instrument D is shown in full lines grasping the handle thereof 36 laying the blade 50 of the pick on top of the abrasive surface 14. Without going into detail concerning the techniques used in sharpening such an instrument, it will suffice for present purposes to note that these blades are manufactured to include at least one flat, but not necessarily planar, surface 52 that can best be seen in FIGS. 1 and 3 where the blade on the righthand end of the handle has been grossly exaggerated in size for purposes of illustration. As shown, the complexly curved pick blade has two such flat surfaces, one 52A on the inside of the curve and a second 52B on the outside. Now, these flats all bear a precise angular relationship to the longitudinal axis of the handle 46 and, more important, this angular relationship does not change despite the fact that it may consist of a complex curve. In simple terms, if some portion in from the tip of the outside flat 52B of the blade 50 on the lefthand end of the handle were laid flush atop the abrasive surface 14 as shown in full lines in FIG. 1 and the instrument drawn to the right through the two phantom-line positions shown therein while, at the same time, twisting the handle with the fingers until just the tip of the blade lie in contact with the abrasive surface, the flat surface would remain in face-to-face contacting relation with such surface at all times and, in addition, the angle the handle makes with the aforesaid abrasive surface would remain the same assuming, of course, that the flat surface was correctly shaped to begin with. This being the case, the single most important thing to do while sharpening or otherwise reconditioning a dental instrument like the one shown is to reestablish the proper angular relationship between the handle and the abrasive surface 14. This may be accomplished in any one of several ways.

If, for example, the flat surface is still intact, then the operator need only reestablish this angle and set the upper handle alignment indicia 44 at the same angle by rotating the protractor-like element into the position shown in FIGS. 1 and 2 where the handle lies between and parallel the two heavy black lines. To recondition the tool, he or she would then merely draw the instrument to the right while rotating same toward the tip but being careful to maintain this same angular relationship between the handle and the abrasive surface as indicated clearly by the phantom lines. With but a bit of practice, this is easily done especially when the operator can view the progress of the tool through the transparent protractor-like element. An even clearer view of the operation can be had by cutting away a halfmoon-shaped piece out of the top half of the protractor as indicated at 56.

In the interests of clarity, the lefthand which is ordinarily used to hold the hone by the base 12 has not been shown in any of the figures; however, this is the preferred way to use the tool, i.e. hand-held as opposed to being bench-mounted. When hand-held by the base, the whole unit can be twisted and turned to whatever position gives the operator the best view of the sharpening operation.

More often than not, a dull instrument will not have properly oriented flat surfaces if, in fact, it has any left at all due to poor sharpening techniques practiced in the past. When this is the case, and it usually is, then the operator must resort to some sort of data telling what the angle between the handle and the abrasive surface should be and was when it came from the manufacturer. Fortunately, such data is readily available and applicant finds it helpful to print it upon the lower half B of the protractor-like element although it has not been shown. If, for example, data from the manufacturer on a particular instrument says that one of its flat surfaces requires that the angle be +40°, then it is only necessary to set the index mark 42 at 40° on scale 48T, whereupon, handle-alignment indicia 44 will be properly angled relative to the abrasive surface 14 to set the handle 36 as shown in full lines. Now, while it is not absolutely necessary to lock the protractor-like element in adjusted position since neither the instrument or the fingers contact it during the sharpening operation, nevertheless, it is preferable to do so. It is for this purpose that a thumbscrew 54 is threaded through a leaf 20 of the base and across the slot 26 into position to contact the face of the protractor-like element to prevent it from rotating as seen most clearly in FIG. 3.

FIGS. 2 and 4 show the handle of the instrument tilted in the opposite direction and the hand of the operator being used in a manner to more or less draw the tool across the body from left to right when tilted on its side as opposed to pulling it toward the body when in a more upright position in the manner of FIGS. 1 and 3. As shown, the base has been turned 180° to bring the abrasive surface shown nearest the viewer in FIG. 1 into play but now in the rear. When it is done this way, the protractor-like member need not be readjusted. On the other hand, if the same abrasive surface shown being used in FIGS. 1 and 3 is to be used to sharpen the instrument in the attitude of the one in FIGS. 2 and 4, the protractor will have to be reset.

It is significant to note that these instruments contain curving flat surfaces like 52A on the inside of a curve where they cannot be reached to sharpen them with the handle above the plane of the abrasive surfaces as previously described. Instead, the handle must extend down below the plane of the abrasive surfaces as seen in FIG. 1. It is for this purpose that a second set of handle-orienting indicia 46 are provided that can be viewed by the operator through the leaves 20 of the transparent base. A negative scale 48B is provided for this purpose on the bottom half of the protractor-like element 16 as seen in the broken-away portion of FIG. 1. Like the angle-indicating indicia 48T on the top half of the protractor-like element, it is divided into two 90° quadrants, one reading from the front so to speak of the unit and the other from the back. All scales are, of course, indexable in one position or another to index mark 42. There is no reason, of course, to rotate the protractor-like element more than a quarter turn at any time.

Finally, in both FIGS. 1 and 3, some letters 58 have been shown alongside the angle-indicating indicia 48 at certain locations. These are nothing more than specific angles that virtually all manufacturers use for certain types of instruments. In other words, if instruments have what is known in the dental profession as a #13 or #14 tip, they all have angles relative to the handle of +40°, therefore, it is much simpler for the user to have a single letter indicate such an angular relation rather than have to look up the particular angle and set it by means of the degree indicia 48.

What is claimed is:

1. A hone for reconditioning dental instruments of the type having a handle terminating at an end thereof in a blade sharpenable to produce a flat surface bordered by at least one knife edge which comprises: a horizontally-disposed substantially planar base adapted to support the hand holding the instrument for slidable movement therealong while its handle is rotated, means for sharpening the blade including a pair of abrasive surfaces arranged in side-by-side relation atop the base and cooperating with one another to define a slot therebetween, angle-measurement means including a protractor-like element mounted for rotation within the slot between the abrasive surfaces in substantially right-angular relation thereto, handle-orienting indicia carried by said protractor-like element of the angle-measurement means comprising means defining at least one straight line movable therewith through a plurality of angular relationships relative to said planar abrasive surfaces, and angle-indicating indicia on said portractor-like element consisting of a plurality of discrete markings each cooperating with the handle-orienting indicia to define a predetermined angular relationship that a handle of a particular dental instrument held in parallel relation to said handle-orienting indicia must bear to one of said pair of abrasive surfaces while being drawn therealong and simultaneously twisted in order to restore the flat and sharpened surfaces of its blade.

2. The hone for reconditioning dental instruments as set forth in claim 1 in which: the protractor-like element is transparent.

3. The hone for reconditioning dental instruments as set forth in claim 1 in which: the instrument handle has thickness,and in which the handle-orienting indicia comprises a pair of parallel lines spaced apart approximately the thickness of said instrument handle.

4. The hone for reconditioning dental instruments as set forth in claim 1 in which: the base is transparent, the protractor-like element is substantially circular, and said protractor-like element is mounted for rotation in position such that one portion thereof projects above the base and the remaining portion thereof is housed within the base and is visible therethrough.

5. The hone for reconditioning dental instruments as set forth in claim 1 in which: the axis of rotation of the protractor-like element lies spaced beneath the plane of the abrasive surface and, in which means defining a fixed reference mark spaced beneath the plane of said abrasive surface the same distance as said axis of rotation cooperates with the markings of the angle-indicating indicia upon alignment therewith to display the angular relation between said abrasive surface plane and the handle-orienting indicia.

6. The hone for reconditioning dental instruments as set forth in claim 2 in which: the base is transparent, the protractor-like element is substantially circular and mounted for rotation on the base such that a portion thereof lies within said base and is visible therethrough, and in which the handle-orienting indicia includes at least one straight line so positioned that a portion thereof remains visible at all times through the transparent base irrespective of the angular position of said protractor-like element.

7. The hone for reconditioning dental instruments as set forth in claim 1 in which: the protractor-like element is substantially circular and the handle-orienting indicia comprises at least one chordal line and a diametrical line arranged in spaced parallel relation to one another.

8. The hone for reconditioning dental instruments as set forth in claim 2 in which: the protractor-like element is mounted such that a portion thereof projects beyond the base, and in which said projecting portion includes a window-forming cutout.

9. The hone for reconditioning dental instruments as set forth in claim 4 in which: at least one of the handle-orienting indicia is visible at all times through the transparent base.

10. The hone for reconditioning dental instruments as set forth in claim 6 in which: the handle orienting indicia is diametrical.

* * * * *